US011203100B2

(12) United States Patent
Kuo et al.

(10) Patent No.: US 11,203,100 B2
(45) Date of Patent: Dec. 21, 2021

(54) TORQUE STRUCTURE

(71) Applicants: Wen-Chin Kuo, Taichung (TW); Hung-Wen Huang, Taichung (TW)

(72) Inventors: Wen-Chin Kuo, Taichung (TW); Hung-Wen Huang, Taichung (TW)

( * ) Notice: Subject to any disclaimer, the term of this patent is extended or adjusted under 35 U.S.C. 154(b) by 212 days.

(21) Appl. No.: 16/743,050

(22) Filed: Jan. 15, 2020

(65) Prior Publication Data

US 2021/0213592 A1 Jul. 15, 2021

(51) Int. Cl.

| | |
|---|---|
| ***B25B 23/159*** | (2006.01) |
| ***B25B 23/142*** | (2006.01) |
| *B25B 13/46* | (2006.01) |

(52) U.S. Cl.

CPC ..... *B25B 23/1427* (2013.01); *B25B 13/462* (2013.01)

(58) Field of Classification Search

CPC .. B25B 23/1427; B25B 13/462; B25B 13/463

USPC ..... 81/483, 478, 467

See application file for complete search history.

(56) References Cited

U.S. PATENT DOCUMENTS

| | | | | |
|---|---|---|---|---|
| 5,497,682 | A * | 3/1996 | Hsu | B25B 23/1427 81/478 |
| 8,863,624 | B2 | 10/2014 | Chen | |
| 2011/0113936 | A1* | 5/2011 | Chiang | B25B 23/1427 81/483 |
| 2013/0228053 | A1* | 9/2013 | Chen | B25B 23/1427 81/467 |

* cited by examiner

*Primary Examiner* — Joseph J Hail
*Assistant Examiner* — Shantese L McDonald
(74) *Attorney, Agent, or Firm* — Karin L. Williams; Alan D. Kamrath; Mayer & Williams PC

(57) ABSTRACT

A torque structure includes a first body provided with a receiving recess, a second body pivotally connected with the first body, a first elastic member received in the second body, a retaining unit including a mounting seat provided with a first threaded portion and a plurality of first through holes, a first adjusting member provided with a head, a positioning seat provided with a plurality of second through holes, and a locking unit including a plurality of first locking members, a second locking member, a plurality of third locking members, a fourth locking member, a fastening member, and a second adjusting member. The fastening member is provided with a fitting portion connected with the first body. The fastening member is provided with a third threaded portion. The second adjusting member is provided with a fourth threaded portion screwed into the third threaded portion.

8 Claims, 13 Drawing Sheets

B-B

TORQUE STRUCTURE

BACKGROUND OF THE INVENTION

1. Field of the Invention

The present invention relates to a hand tool and, more particularly, to a torque structure, such as a torque (or torsion) wrench or the like.

2. Description of the Related Art

A conventional torque wrench was disclosed in the U.S. Pat. No. 8,863,624, and comprises a hollow main shaft 10, a tool member 20, an adjustable grip 30, a torque-adjustment elastic member 40, a clutch device 50, and a functional lock 60. The hollow main shaft 10 comprises a first end 11, a second end 12 opposite to the first end 11, and a plurality of locating grooves 13 spaced around the periphery of the second end 12, while plural torque value numbers 14 are disposed on the periphery of the hollow main shaft 10. The tool member 20 comprises a head piece 21 made in the form of, for example, a ratchet socket joint, and a stem 22 inserted into the inside of the first end 11 of the hollow main shaft 10. The adjustable grip 30 comprises an adjustment screw member 31 fixedly mounted therein on the center and screwed to the second end 12 of the hollow main shaft 10 for allowing the adjustable grip 30 to rotate against the hollow main shaft 10, with a ring groove 301 disposed on the periphery of one end of the adjustable grip 30 opposite to the end combined to the hollow main shaft 10. The torque-adjustment elastic member 40 mounts inside the hollow main shaft 10 and is stopped against one end of the adjustment screw member 31. At least a stopper member 41 is disposed between the torque-adjustment elastic member 40 and one end of the adjustment screw member 31 for allowing the torque-adjustment elastic member 40 to be indirectly stopped against one end of the adjustment screw member 31. The clutch device 50 is set between the torque-adjustment elastic member 40 and the tool member 20, pushable by the torque-adjustment elastic member 40 between an engaged position and a disengaged position. The clutch device 50 includes a plurality of block members movable by the torque-adjustment elastic member 40 to abut against one another. The functional lock 60 is disposed on the outer periphery of the second end 12 of the hollow main shaft 10 and axially moveable between a locked position and an unlocked position along the hollow main shaft 10. The functional lock 60 comprises a locking ring 61, a compression spring 62, a C-clasp 63, at least a through hole 64, and at least a positioning ball 65. The locking ring 61 mounts in between the second end 12 of the hollow main shaft 10 and the adjustable grip 30, with a containing groove 611 disposed on one end of the inner wall of the locking ring 61, a pushing face 612 axially extending from the containing groove 611 toward the adjustable grip 30, and a spring groove 613 disposed on the other end of the inner wall of the locking ring 61. An annular groove 614 is disposed in the spring groove 613, while the inner diameter of the spring groove 613 is smaller than the inner diameter of the annular groove 614. In addition, an anti-sliding portion 615 comprising plural ditches mounts around the outer periphery of the locking ring 61, and the pushing face 612 is located in a position higher than the groove bottom of the containing groove 611. A bevel 616 is disposed on the junction between the containing groove 611 and the pushing face 612. The compression spring 62 is disposed between the locking ring 61 and the adjustable grip 30 and permanently pushing the locking ring 61. The C-clasp 63 is made of medal and disposed on a ring groove 301 of the adjustable grip for being optionally coupled with the annular groove 614, whereby the locking ring 61 is located in the unlocked position. At least a through hole 64 is disposed on the periphery of the adjustable grip 30. Preferably, the adjustable grip 30 comprises a hollow extension tube 32 sleeving the locating groove 13, and the through hole 64 is disposed on the periphery of the extension tube 32, while one end of the extension tube 32 is provided with plural level value numbers 321 as a reference corresponding to the torque value number 14 on the hollow main shaft 10. The periphery of the extension tube 32 is provided with a position limiting hole 322 which is 90 degrees apart from the through hole 64 on the periphery of the extension tube 32. The distance between the position limiting hole 322 and the adjustable grip 30 is longer than the distance between the through hole 64 and the adjustable grip, while a position limiting ball 66 is received in the position limiting hole 322 for limiting the movement of the locking ring 61. The at least one positioning ball 65 made of medal is received in the through hole 64 for corresponding with the locating groove 13, wherein the diameter of the positioning ball 65 is smaller than the diameter of the position limiting ball 66.

However, the conventional torque wrench has the following disadvantages.

1. The hollow main shaft 10 and the adjustable grip 30 are locked by the functional lock 60, such that when the adjustable grip 30 is rotated, the hollow main shaft 10 is rotated by the adjustable grip 30. The positioning ball 65 bears the rotation force of the adjustable grip 30 individually, such that the force is not distributed evenly, and the positioning ball 65 has to withstand a large force.

2. The functional lock 60 is mounted between the hollow main shaft 10 and the adjustable grip 30, thereby decreasing the aesthetic quality of the conventional torque wrench.

3. The hollow main shaft 10 comprises a plurality of locating grooves 13. Each of the locating grooves 13 has a noncircular shape and has a determined length, such that the locating grooves 13 greatly increase the cost of the hollow main shaft 10.

BRIEF SUMMARY OF THE INVENTION

The primary objective of the present invention is to provide a torque structure having a reinforced strength.

In accordance with the present invention, there is provided a torque structure comprising a first body provided with a receiving recess, a second body pivotally connected with the first body, a first elastic member received in the second body, a retaining unit including a mounting seat which is provided with a first threaded portion and a plurality of first through holes, a first adjusting member provided with a head, a positioning seat provided with a plurality of second through holes, and a locking unit including a plurality of first locking members, a second locking member, a plurality of third locking members, a fourth locking member, a fastening member, and a second adjusting member. The fastening member is provided with a fitting portion connected with the first body. The fastening member is provided with a third threaded portion. The second adjusting member is provided with a fourth threaded portion screwed into the third threaded portion.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
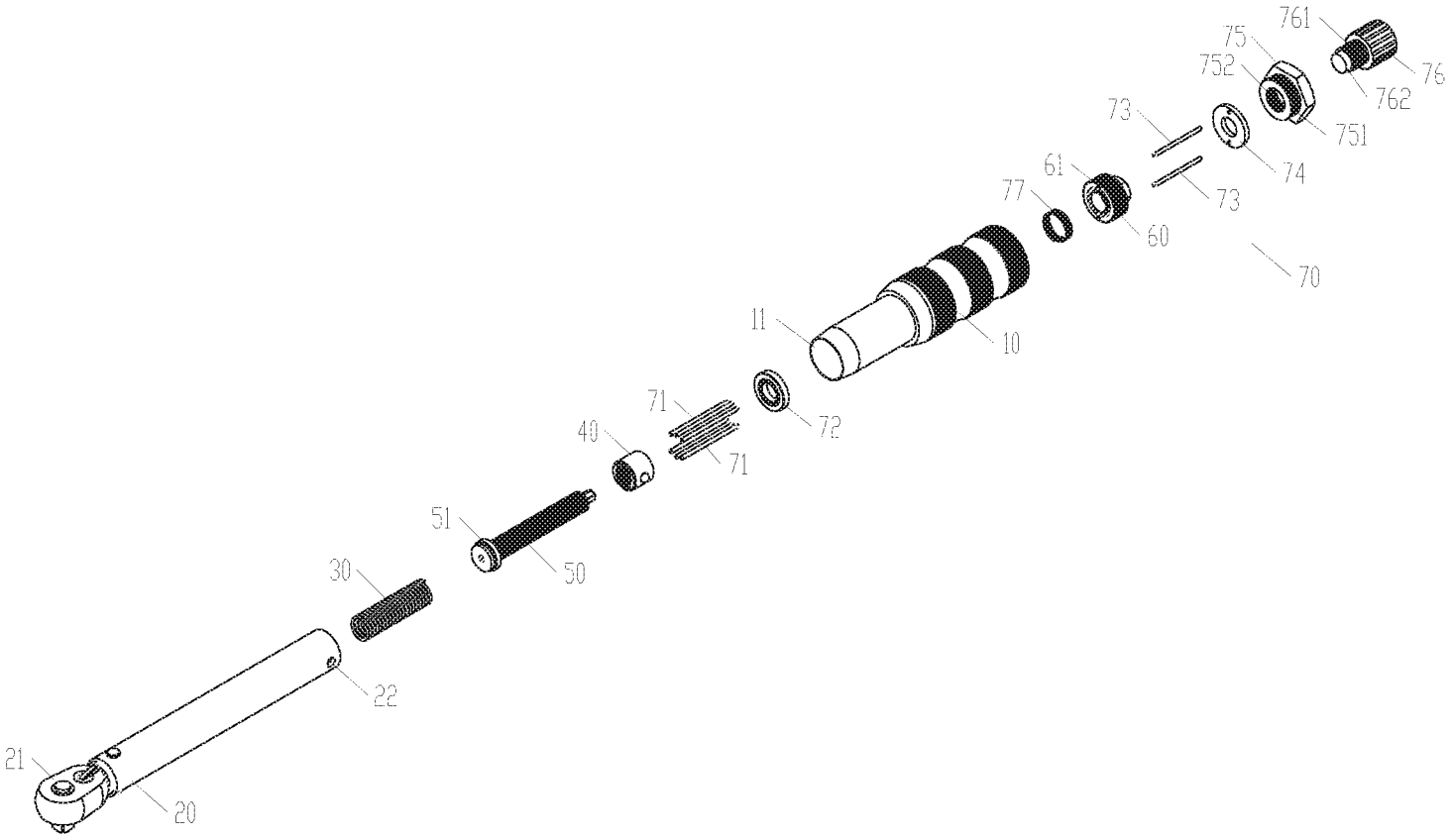
FIG. 1 is an exploded perspective view of a torque structure in accordance with the preferred embodiment of the present invention.
Figure 2:
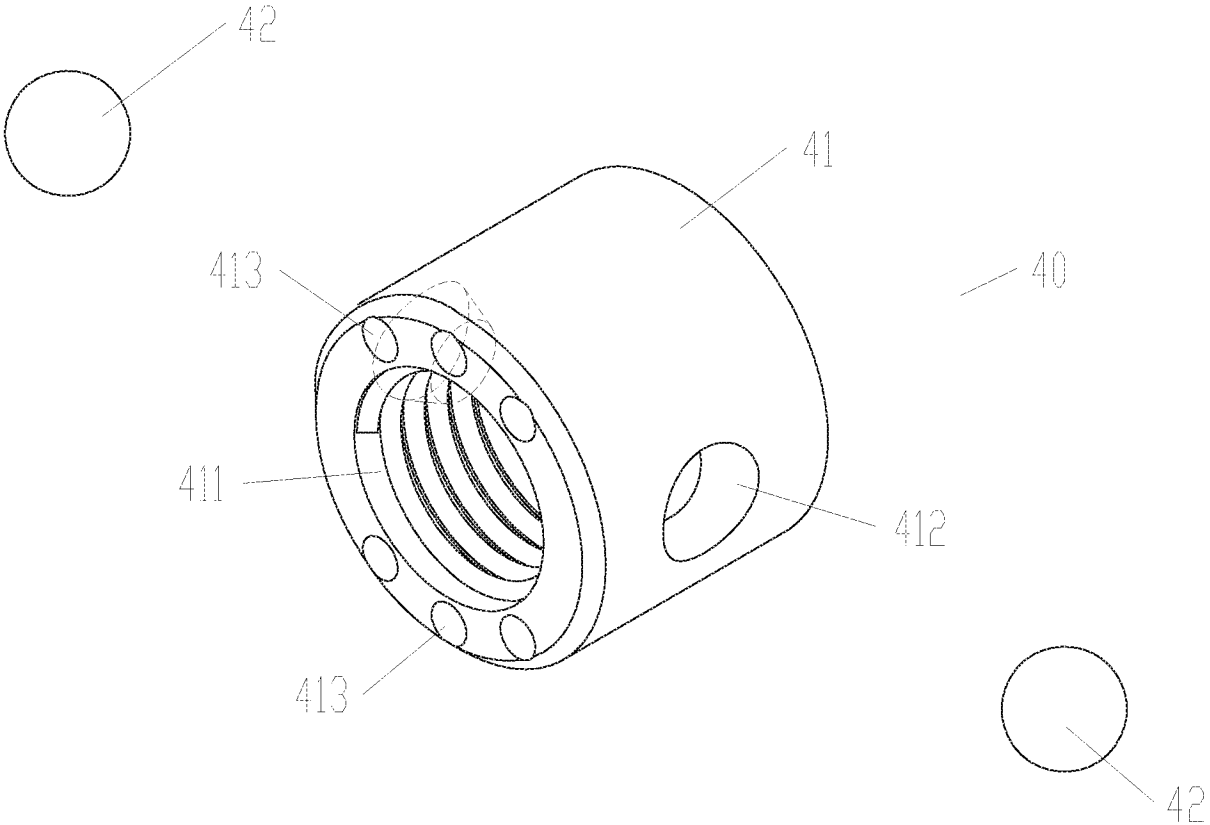
FIG. 2 is an exploded perspective view of a retaining unit of the torque structure in accordance with the preferred embodiment of the present invention.
Figure 3:
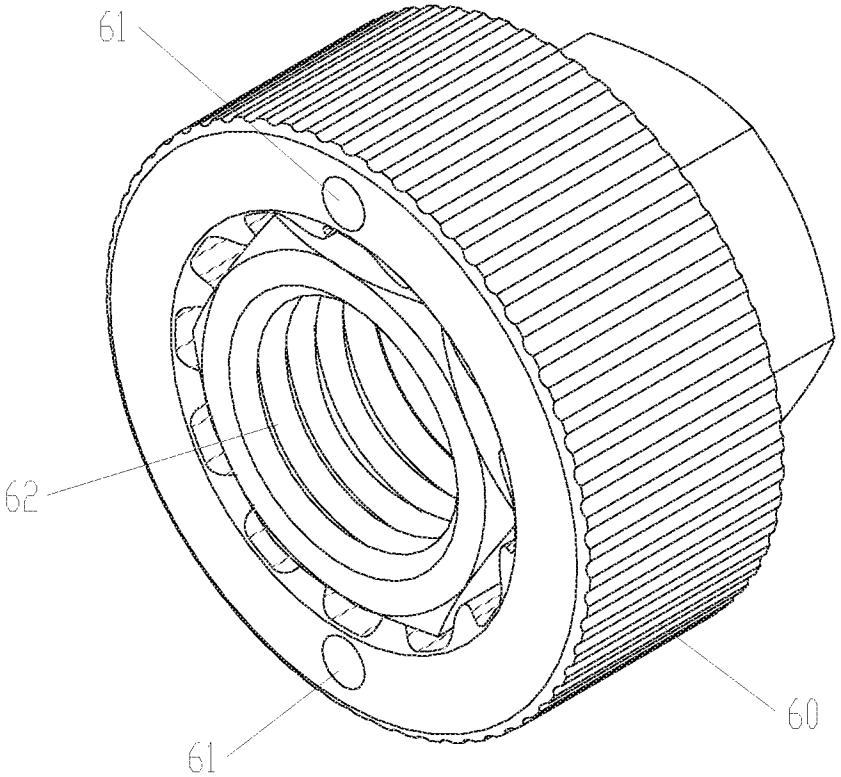
FIG. 3 is a perspective view of a positioning seat of the torque structure in accordance with the preferred embodiment of the present invention.
Figure 5:
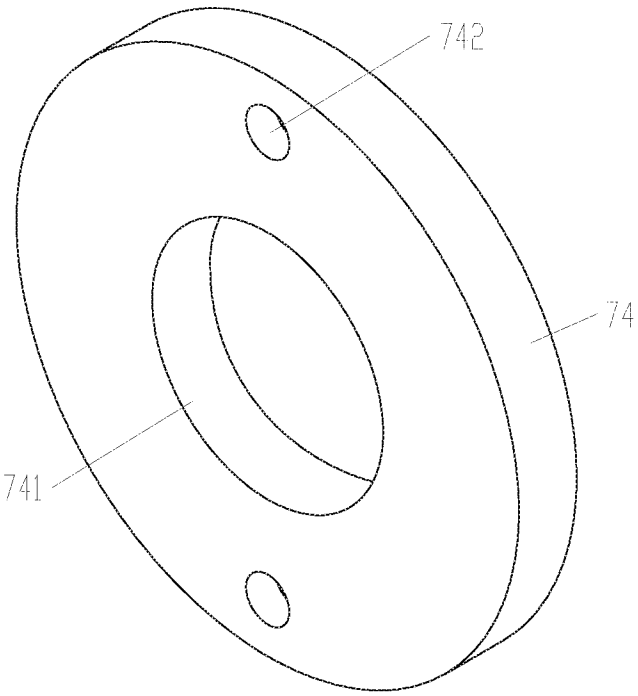
FIG. 5 is a perspective view of a fourth locking member of the torque structure in accordance with the preferred embodiment of the present invention.
Figure 4:
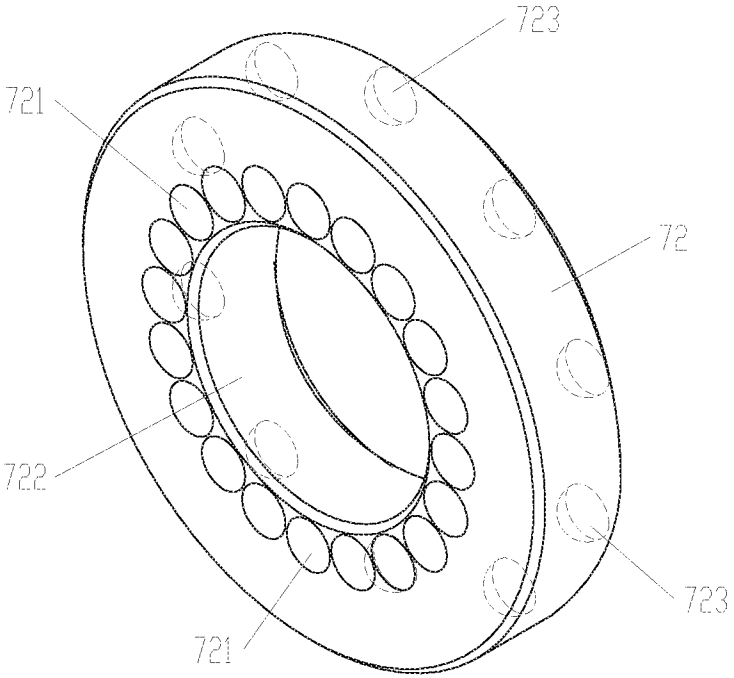
FIG. 4 is a perspective view of a second locking member of the torque structure in accordance with the preferred embodiment of the present invention.

Referring to the drawings and initially to FIGS. 1-10, a torque structure in accordance with the preferred embodiment of the present invention comprises a first body 10, a second body 20, a first elastic member 30, a retaining unit 40, a first adjusting member 50, a positioning seat 60, and a locking unit 70.

The first body 10 has an interior provided with a receiving recess 11, and has an end provided with a grip.

The second body 20 is pivotally connected with the first body 10, and has a first end provided with a drive portion 21 protruding from the first body 10, and a second end provided with a plurality of first fixing portions 22 hidden in the receiving recess 11. The first fixing portions 22 are located adjacent to an opening of the second body 20, and are arranged in an annular shape about an axis of the second body 20.

The first elastic member 30 is received in and elastically biased on the second body 20, such that the second body 20 has an over-torque slipping function.

The retaining unit 40 is secured in the second body 20, and located adjacent to the opening of the second body 20. The retaining unit 40 is distant from the drive portion 21, and includes a mounting seat 41, and a plurality of securing members 42.

The mounting seat 41 is a ring that is secured in the second body 20, and located adjacent to the opening of the second body 20. The mounting seat 41 has an interior provided with a first threaded portion 411 which is an internal thread extending through the mounting seat 41. The mounting seat 41 is provided with a plurality of second fixing portions 412 aligning with the first fixing portions 22. The second fixing portions 412 have a number equal to that of the first fixing portions 22. The mounting seat 41 is provided with a plurality of first through holes 413 which extend in a direction the same as that of the first threaded portion 411. The first through holes 413 surround the first threaded portion 411.

The securing members 42 are mounted on the first fixing portions 22 and the second fixing portions 412, such that the mounting seat 41 is secured in and is not detached from the second body 20. The securing members 42 have a number equal to that of the first fixing portions 22 and that of the second fixing portions 412.

The first adjusting member 50 is mounted in the receiving recess 11, the second body 20, and the mounting seat 41, and has an external thread screwed through the first threaded portion 411. The first adjusting member 50 is rotated relative to the first threaded portion 411 and moved relative to the retaining unit 40, such that the first adjusting member 50 is moved relative to the second body 20. The first adjusting member 50 is provided with a head 51 which presses the first elastic member 30, with the first elastic member 30 being biased between the second body 20 and the head 51.

In practice, when the first body 10 is rotated relative to the second body 20, the first adjusting member 50 is driven by and rotated with the first body 10, such that the first adjusting member 50 is rotated and moved in the first threaded portion 411, to adjust a tension of the first elastic member 30.

The positioning seat 60 is secured in the receiving recess 11 and locked on the first adjusting member 50, such that the first body 10, the positioning seat 60, and the first adjusting member 50 are rotated simultaneously. Thus, when the first body 10 is rotated, the positioning seat 60 is rotated with the first body 10, and the first adjusting member 50 is rotated with the positioning seat 60, such that the first adjusting member 50 is rotated and moved in the first threaded portion 411, and the positioning seat 60 is moved with the first adjusting member 50, and is moved relative to the retaining unit 40. The positioning seat 60 is provided with a plurality of second through holes 61 which are arranged in an annular shape about an axis of the positioning seat 60. The positioning seat 60 is provided with a second threaded portion 62 which is an internal thread screwed onto the first adjusting member 50.

The locking unit 70 is assembled with the first body 10, the retaining unit 40, the first adjusting member 50, and the positioning seat 60, and is moved with the first body 10. The locking unit 70 includes a plurality of first locking members 71, a second locking member 72, a plurality of third locking members 73, a fourth locking member 74, a fastening member 75, a second adjusting member 76, and a second elastic member 77.

The first locking members 71 extend through and are moved in the first through holes 413, and have a number equal to that of the first through holes 413. The first locking members 71 are received in the receiving recess 11. Each of the first locking members 71 is a circular rod and has a first end resting on the head 51.

The second locking member 72 is received in the receiving recess 11 and moved relative to the mounting seat 41. The second locking member 72 is adjacent to the positioning seat 60 and has a center provided with a third through hole 722 allowing passage of the first adjusting member 50. The second locking member 72 has a first end provided with a plurality of resting portions 721 each abutting and receiving a second end of each of the first locking members 71. The resting portions 721 are arranged in an annular shape about an axis of the second locking member 72. The second locking member 72 has a second end provided with a plurality of first receiving grooves 723 aligning with the second through holes 61.

The third locking members 73 extend through the second through holes 61 and are moved relative to the positioning seat 60 through a small distance. Each of the third locking members 73 is a circular rod and has a first end resting on and detachably received in one of the first receiving grooves 723.

The fourth locking member 74 is received in the receiving recess 11 and is provided with a plurality of second receiving grooves 742 aligning with the second through holes 61, and each of the third locking members 73 has a second end received or secured in one of the second receiving grooves 742, such that the third locking members 73 are located between the second locking member 72 and the fourth locking member 74. Thus, the positioning seat 60 and the third locking members 73 are arranged between the second locking member 72 and the fourth locking member 74. The second receiving grooves 742 have a number equal to that of the second through holes 61. The fourth locking member 74 is provided with a first mounting portion 741.

The fastening member 75 is secured to the first body 10 such that the fastening member 75 is rotated and moved with the first body 10. The fastening member 75 is provided with a fitting portion 751 connected with the first body 10. The fitting portion 751 is an external thread screwed into an internal thread of the first body 10. The fastening member 75 is provided with a third threaded portion 752 which is an internal thread.

The second adjusting member 76 detachably rests on the fourth locking member 74, and is provided with a fourth threaded portion 761 which is an external thread screwed into the third threaded portion 752. Thus, when the second adjusting member 76 is rotated relative to the fastening member 75, the fourth threaded portion 761 is rotated and moved relative to the third threaded portion 752, such that the second adjusting member 76 is moved to press or release the fourth locking member 74. The fourth threaded portion 761 is provided with a second mounting portion 762 mounted on the first mounting portion 741, such that the second adjusting member 76 is mounted on the fourth locking member 74.

The second elastic member 77 is received in the receiving recess 11 and is biased between the positioning seat 60 and the second locking member 72. The second elastic member 77 is arranged between the third locking members 73.

In practice, when the second adjusting member 76 is rotated and moved, the fourth locking member 74 and the third locking members 73 are pushed by the second adjusting member 76 to move toward an opening of the receiving recess 11, such that the first end of each of the third locking members 73 presses one of the first receiving grooves 723, and the third locking members 73 are locked on and limited by the second locking member 72. Thus, the first body 10 is limited by the locking unit 70 and the retaining unit 40 and cannot be rotated and moved, such that the first body 10 is locked onto and cannot be rotated relative to the second body 20. In such a manner, the second body 20 is rotated when the first body 10 is rotated.

On the contrary, when the second adjusting member 76 is rotated reversely and moved opposite to the opening of the receiving recess 11, the fourth locking member 74 and the third locking members 73 are released from and not limited by the second adjusting member 76, to allow movement of the third locking members 73 and the fourth locking member 74. In such a manner, when the first body 10 is rotated, the positioning seat 60 is rotated with the first body 10, and the third locking members 73 are rotated with the positioning seat 60. At this time, the second locking member 72 is fixed by the first locking members 71 and the fourth locking member 74, such that when the third locking members 73 are rotated relative to the second locking member 72, the third locking members 73 are pushed by the second locking member 72 and detached from the first receiving grooves 723. Thus, the third locking members 73 are unlocked from and not limited by the second locking member 72, such that the first body 10 is not limited by the locking unit 70 and the retaining unit 40 and can be rotated and moved. In such a manner, the first body 10 is unlocked from the second body 20, such that when the first body 10 is rotated relative to the second body 20, the first adjusting member 50 is driven by the first body 10 and moved in the first threaded portion 411, to adjust the tension of the first elastic member 30, and to adjust the torque of the torque structure.

In the preferred embodiment of the present invention, the first body 10 is a circular rod. The receiving recess 11 has a circular shape. The drive portion 21 is a ratchet wrench or an open-end wrench with a square head. The second body 20 has two first fixing portions 22 which are arranged symmetrically. Each of the first fixing portions 22 is a circular hole. The mounting seat 41 has two, three or six first through holes 413, and each of the first through holes 413 has a circular shape. Each of the securing members 42 is a ball. The positioning seat 60 has two second through holes 61 which are arranged symmetrically. Each of the second through holes 61 is a circular hole. The second locking member 72 is a ring. Each of the resting portions 721 is an arcuate groove.

In the preferred embodiment of the present invention, each of the third locking members 73 has a length smaller than that of each of the first locking members 71.

In the preferred embodiment of the present invention, the first mounting portion 741 is a circular hole. The second receiving grooves 742 is a circular groove. The second mounting portion 762 has a circular shape.

Figure 9:
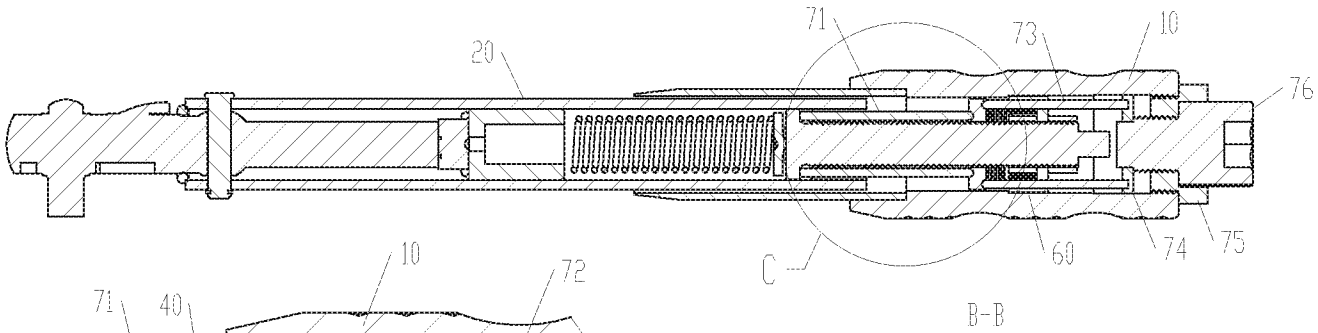
FIG. 9 is a cross-sectional view of a first operation state of the torque structure taken along line B-B as shown in FIG. 8.

In assembly, referring to FIGS. 6-10 with reference to FIGS. 1-5, the second body 20 is pivotally connected with the first body 10. The first elastic member 30 is received in the second body 20. The retaining unit 40 is secured in the second body 20. The first adjusting member 50 is mounted in the receiving recess 11, the second body 20, and the mounting seat 41. The first elastic member 30 being biased between the second body 20 and the head 51. The positioning seat 60 is secured in the receiving recess 11. The locking unit 70 is received in the receiving recess 11. The third locking members 73 is limited by the first locking members 71 and the second locking member 72, and cannot be rotated and moved. Thus, the first body 10 is locked onto and cannot be rotated relative to the second body 20 as shown in FIG. 9.

Figure 12:
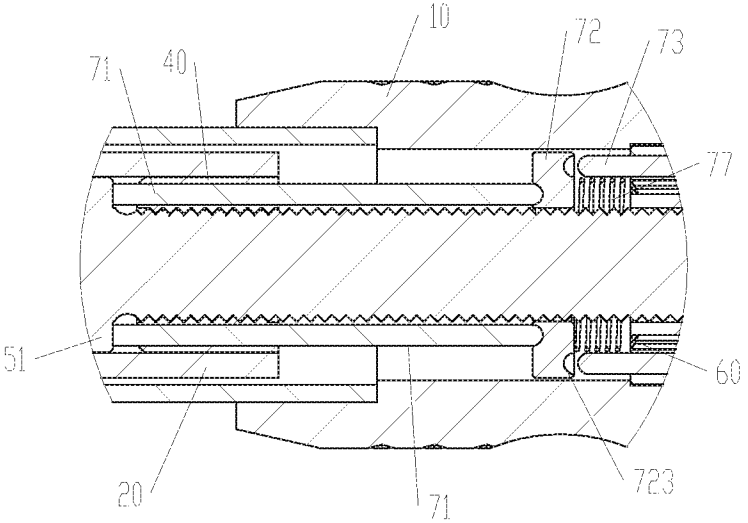
FIG. 12 is an enlarged view of the torque structure taken along mark C as shown in FIG. 11.

In operation, referring to FIGS. 11-14 with reference to FIGS. 1-10, when the second adjusting member 76 is rotated and moved opposite to the opening of the receiving recess 11, the fourth threaded portion 761 is unscrewed from the third threaded portion 752, and the fourth locking member 74 and the third locking members 73 are released from and not limited by the second adjusting member 76, to allow movement of the third locking members 73 and the fourth locking member 74. In such a manner, when the first body 10 is rotated, the positioning seat 60 is rotated with the first body 10, and the third locking members 73 are rotated with the positioning seat 60. At this time, the second locking member 72 is fixed by the first locking members 71 and the fourth locking member 74, such that when the third locking members 73 are rotated relative to the second locking member 72, the third locking members 73 are pushed by the second locking member 72 and detached from the first receiving grooves 723 as shown in FIG. 12. Thus, the third locking members 73 are unlocked from and not limited by the second locking member 72, such that the first body 10 is not limited by the locking unit 70 and can be rotated and moved freely. In such a manner, the first body 10 is unlocked from the second body 20, such that when the first body 10 is rotated relative to the second body 20, the first adjusting member 50 is driven by the first body 10 and moved in the first threaded portion 411, to adjust the tension of the first elastic member 30, and to adjust the torque of the torque structure.

Figure 13:
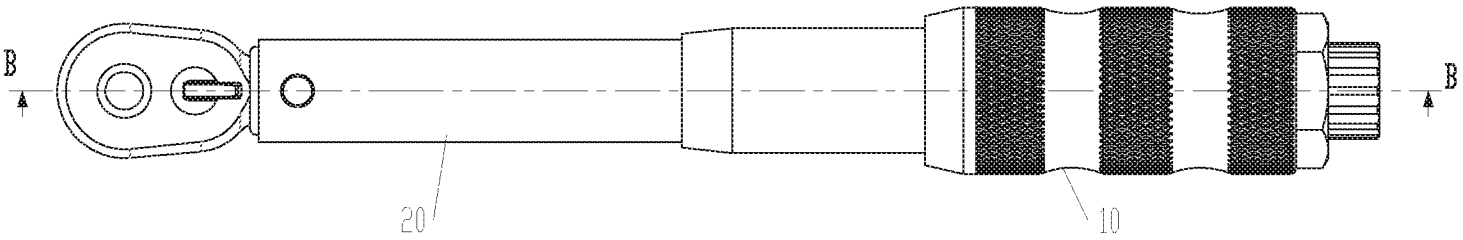
FIG. 13 is a top view of a third operation state of the torque structure in accordance with the preferred embodiment of the present invention.
Figure 14:
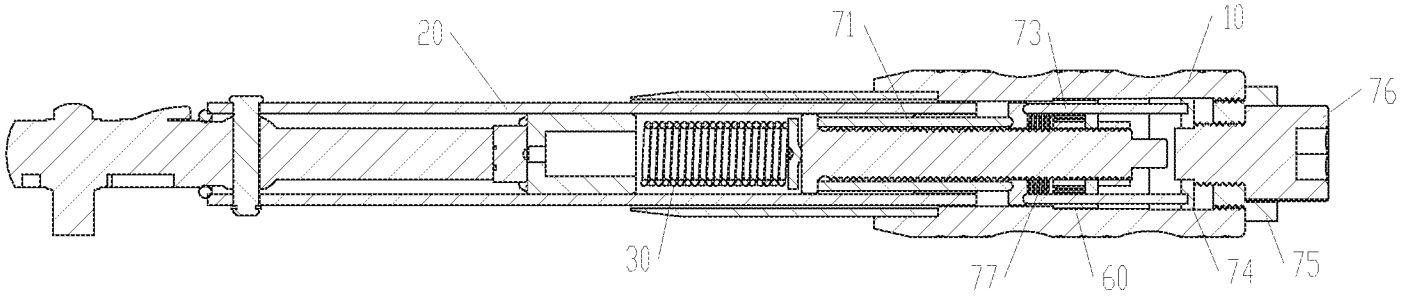
FIG. 14 is a cross-sectional view of the torque structure taken along line B-B as shown in FIG. 13.

As shown in FIGS. 13 and 14, the first elastic member 30 is compressed to increase the torque of the torque structure.

Figure 15:
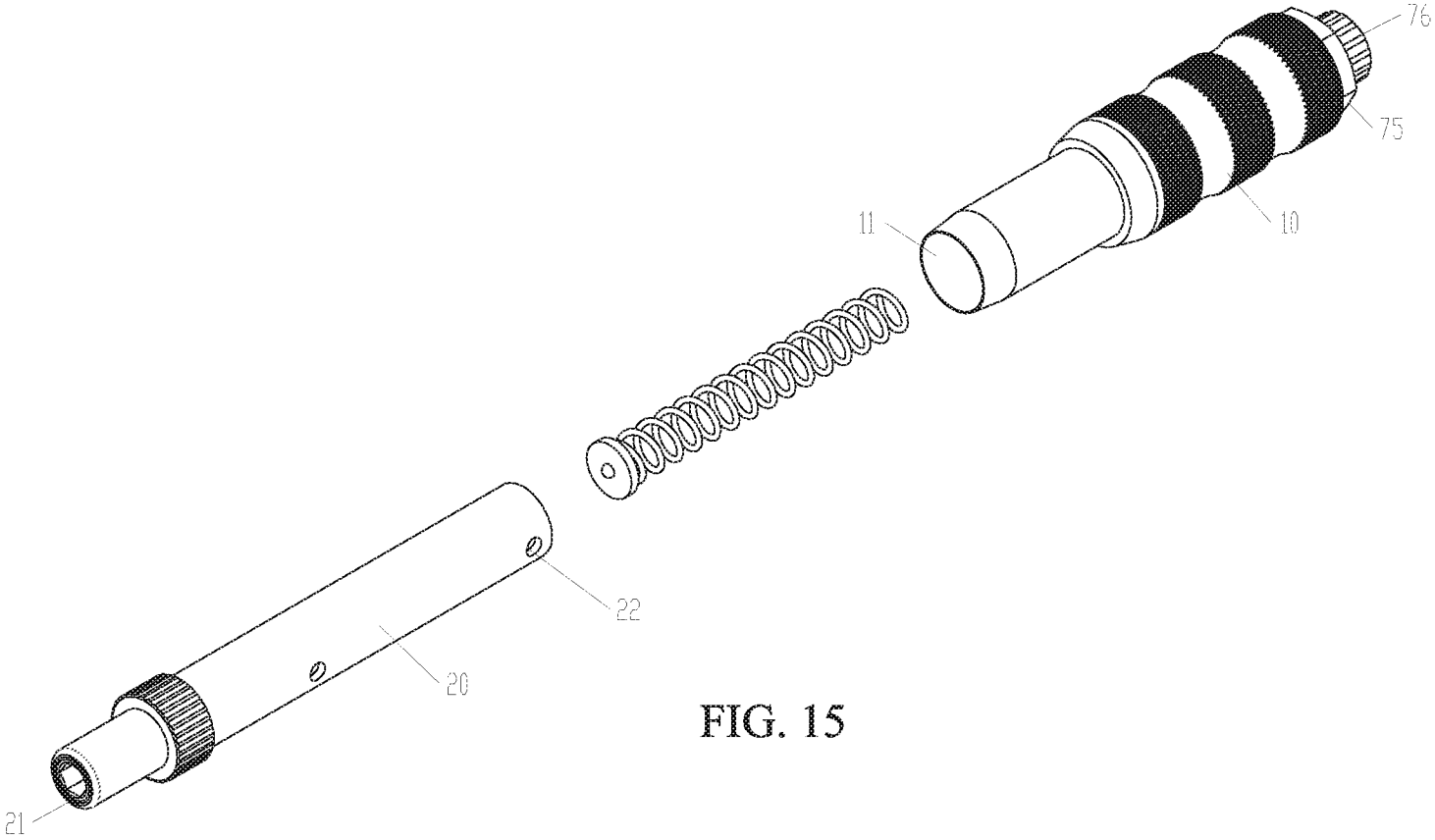
FIG. 15 is a partial exploded perspective view of a torque structure in accordance with the second preferred embodiment of the present invention.
Figure 16:
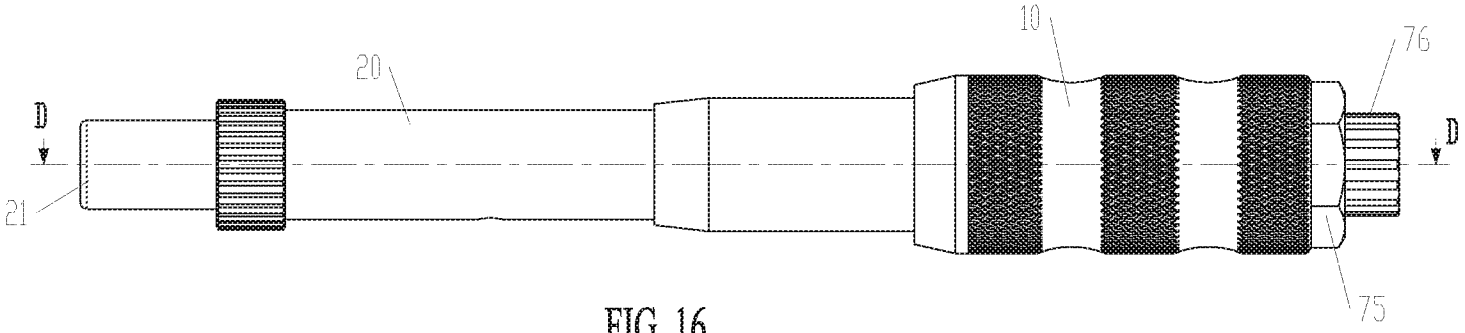
FIG. 16 is a top view of the torque structure in accordance with the second preferred embodiment of the present invention.
Figure 17:
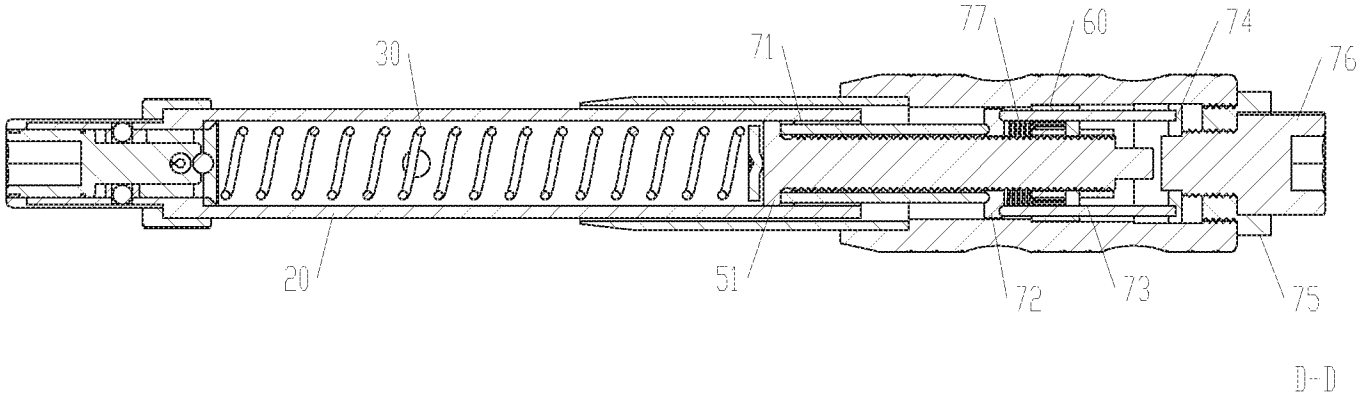
FIG. 17 is a cross-sectional view of the torque structure taken along line D-D as shown in FIG. 16.

Referring to FIGS. 15-17, the drive portion 21 is a hexagonal recess. The first body 10 is rotated about its axis to drive the second body 20. The second body 20 has an over-torque slipping function when rotating about its axis.

Figure 18:
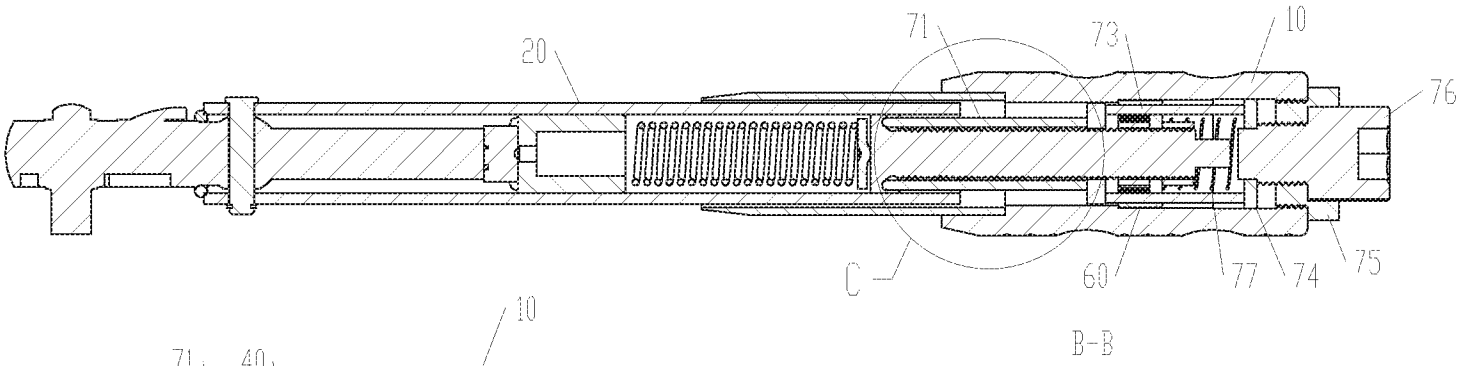
FIG. 18 is a cross-sectional view of a torque structure in accordance with the third preferred embodiment of the present invention.
Figure 19:
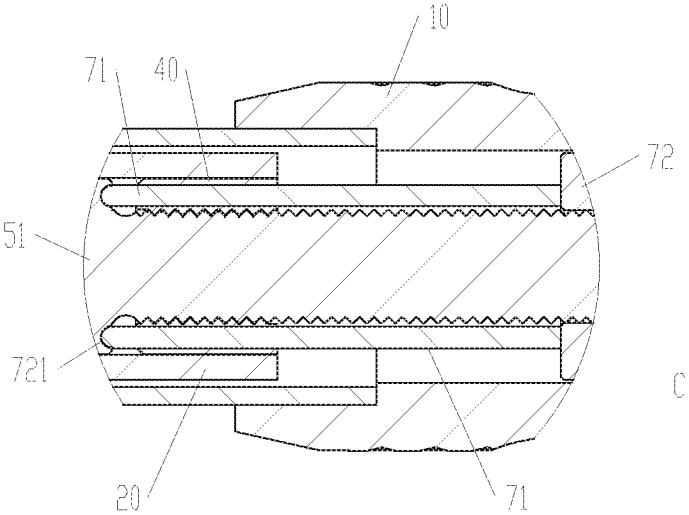
FIG. 19 is an enlarged view of the torque structure taken along mark C as shown in FIG. 18.

Referring to FIGS. 18 and 19, the resting portions 721 are formed on the head 51 of the first adjusting member 50, the first end of each of the first locking members 71 rests on the resting portions 721 of the first adjusting member 50, the second end of each of the first locking members 71 rests on the second locking member 72, and the second elastic member 77 is biased between the positioning seat 60 and the fourth locking member 74. The first receiving grooves 723 are undefined, and the second receiving grooves 742 are undefined.

Figure 20:
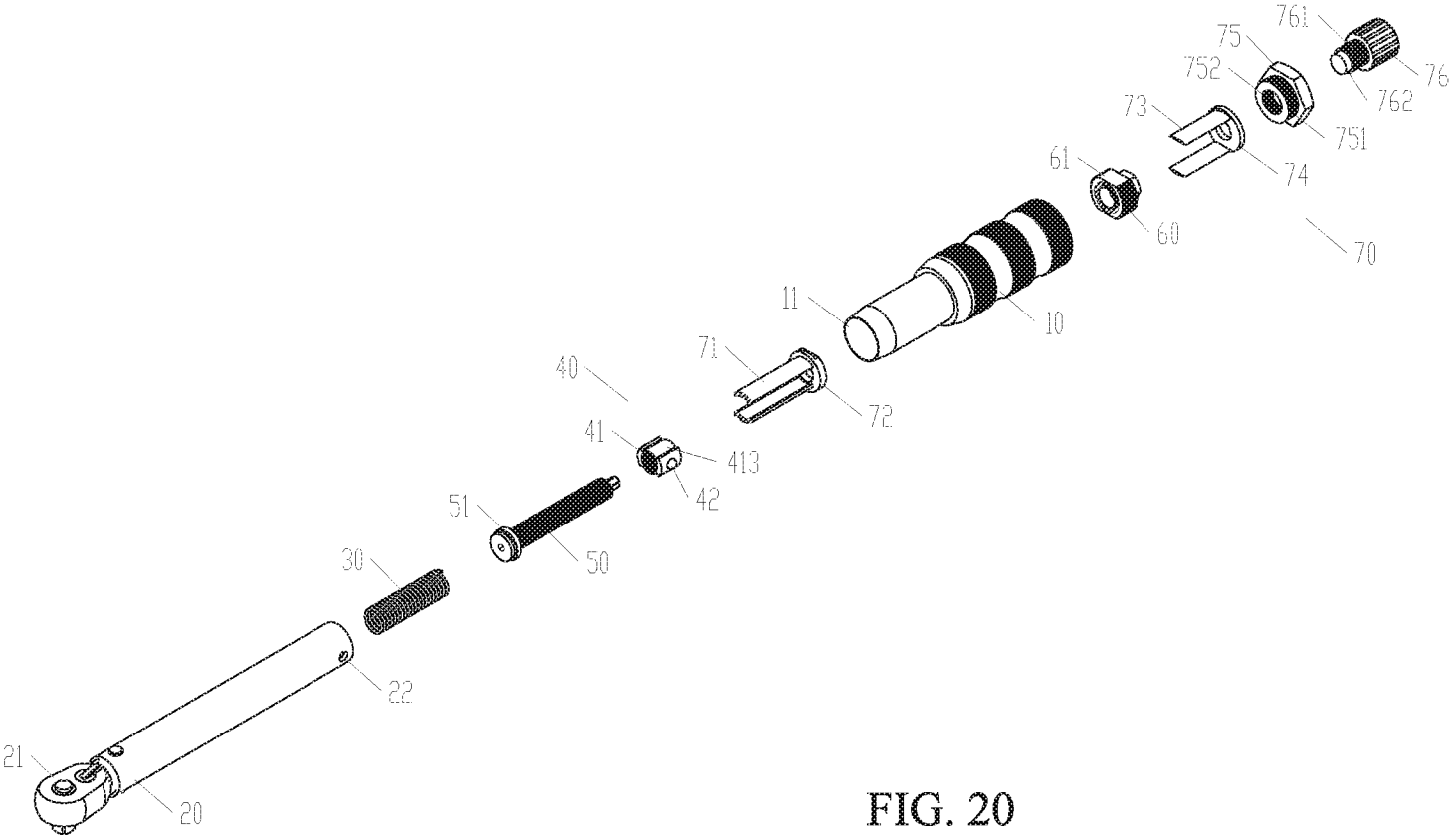
FIG. 20 is an exploded perspective view of a torque structure in accordance with the fourth preferred embodiment of the present invention.

Referring to FIG. 20 with reference to FIG. 1, the mounting seat 41 has two first through holes 413 which are arranged symmetrically and are located between the second fixing portions 412. Each of the first through holes 413 has an open shape. The positioning seat 60 has two second through holes 61 which are arranged symmetrically. Each of the second through holes 61 has an open shape and has a plane. The first locking members 71 and the second locking member 72 are formed integrally. The first locking members 71 directly protrude from the second locking member 72. The third locking members 73 and the fourth locking member 74 are formed integrally. The third locking members 73 directly protrude from the fourth locking member 74. The second elastic member 77 is undefined.

In another preferred embodiment of the present invention, the third locking members 73 and the second locking member 72 are formed integrally. The third locking members 73 directly protrude from the second locking member 72.

Figure 10:
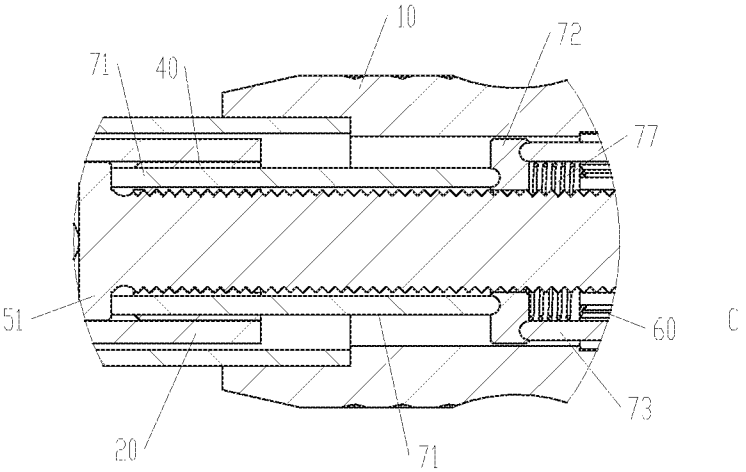
FIG. 10 is an enlarged view of the torque structure taken along mark C as shown in FIG. 9.
Figure 11:
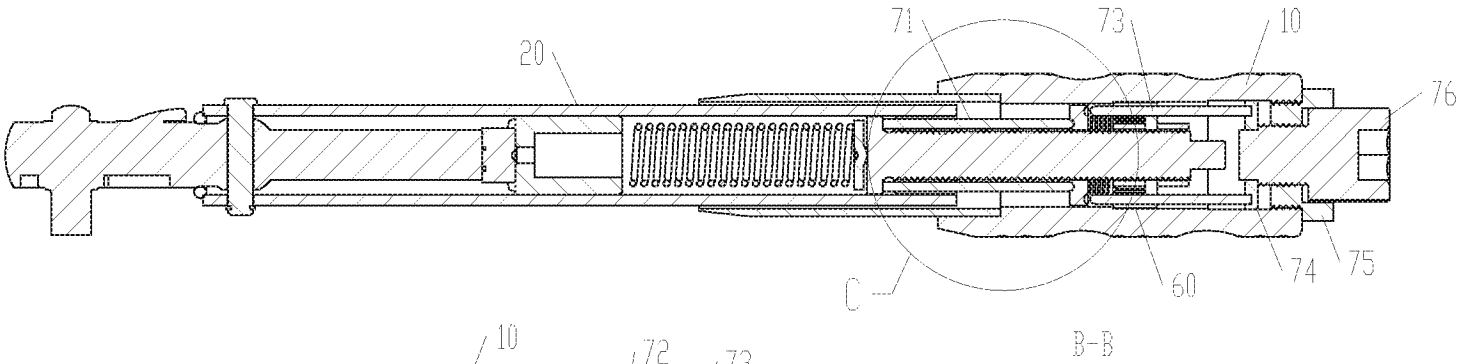
FIG. 11 is a cross-sectional view of a second operation state of the torque structure taken along line B-B as shown in FIG. 8.

The principle of the present invention is described as follows. The first locking members 71 extend through and are moved in the first through holes 413, such that the first locking members 71 are limited by the mounting seat 41 and cannot be rotated. The second locking member 72 is limited by the first locking members 71 and cannot be rotated. The third locking members 73 are locked in the first receiving grooves 723 as shown in FIG. 10, such that the third locking members 73 are locked by the second locking member 72 and cannot be rotated. The third locking members 73 extend through the second through holes 61, such that the positioning seat 60 is limited by the third locking members 73 and cannot be rotated. The positioning seat 60 is secured in the receiving recess 11, such that the first body 10 is limited by the positioning seat 60 and cannot be rotated. Thus, the first body 10 is disposed at a locked state. When the third locking members 73 are detached from the first receiving grooves 723 as shown in FIG. 12, the third locking members 73 is unlocked from the second locking member 72 and can be rotated by the first body 10, such that the first body 10 is disposed at an unlocked state. Thus, the first body 10 is rotated freely relative to the second body 20.

In conclusion, the first locking members 71 is fixed, and the second locking member 72 connects the first locking members 71 and the third locking members 73, such that when the third locking members 73 is locked by the second locking member 72, the third locking members 73 is secured by the first locking members 71 and the second locking member 72, and when the third locking members 73 is unlocked from the second locking member 72, the third locking members 73 is released from the first locking members 71 and the second locking member 72.

In another preferred embodiment of the present invention, the second elastic member 77 is biased between the positioning seat 60 and the fourth locking member 74.

Accordingly, the advantages of the torque structure of the present invention are described as follows.

1. The first locking members 71 extend through the first through holes 413, such that when the first body 10 is rotated to drive the second body 20, the first locking members 71 bear and evenly distribute the rotation force of the first body 10. Thus, the first locking members 71 have a better support force. The first locking members 71 are replaced when being broken, thereby decreasing the cost.

2. Each of the first locking members 71 is a circular rod. Each of the third locking members 73 is a circular rod. The second locking member 72 has a sheet shape. The fourth locking member 74 has a sheet shape. The resting portions 721, the first receiving grooves 723, and the second receiving grooves 742 are formed by punching, stamping or pressing. Thus, the first locking members 71, the second locking member 72, the third locking members 73, and the fourth locking member 74 have lower cost.

3. As shown in FIG. 9, the first locking members 71 cannot be rotated, such that the second locking member 72 and the third locking members 73 cannot be rotated. Thus, the first adjusting member 50 is limited by the locking unit 70 and cannot be rotated and moved, such that the first body 10 is locked onto and cannot be rotated relative to the second body 20.

4. When the second adjusting member 76 is rotated and moved opposite to the opening of the receiving recess 11, the fourth threaded portion 761 is unscrewed from the third threaded portion 752, and the fourth locking member 74 and the third locking members 73 are released from and not limited by the second adjusting member 76, to allow movement of the third locking members 73 and the fourth locking member 74, the third locking members 73 are detached from the first receiving grooves 723 as shown in FIG. 12. Thus, the third locking members 73 are unlocked from and not limited by the second locking member 72, such that the first body 10 is not limited by the locking unit 70 and can be rotated and moved freely. In such a manner, the first body 10 is unlocked from the second body 20, such that when the first body 10 is rotated relative to the second body 20, the first adjusting member 50 is driven by the first body 10 and moved in the first threaded portion 411, to adjust the tension of the first elastic member 30, and to adjust the torque of the torque structure.

Figure 6:
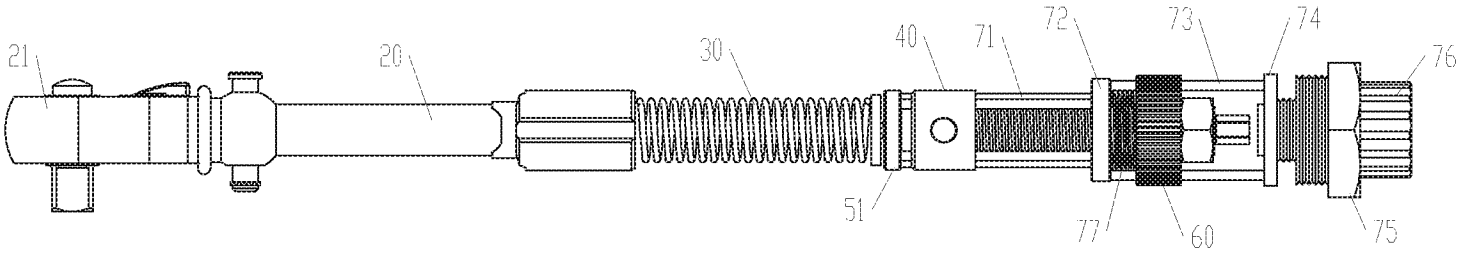
FIG. 6 is a partial side view of the torque structure in accordance with the preferred embodiment of the present invention.
Figure 7:
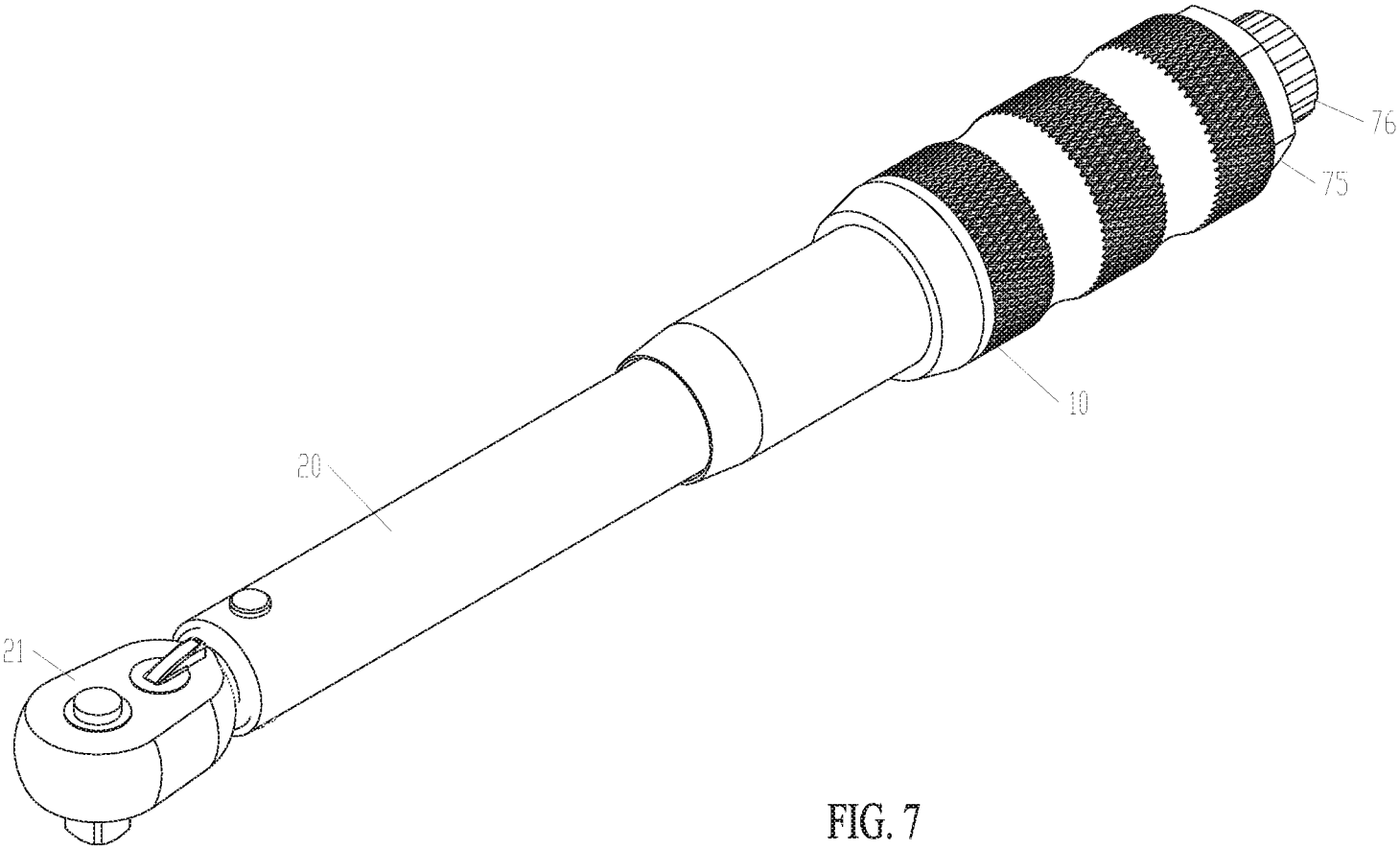
FIG. 7 is a perspective view of the torque structure in accordance with the preferred embodiment of the present invention.
Figure 8:
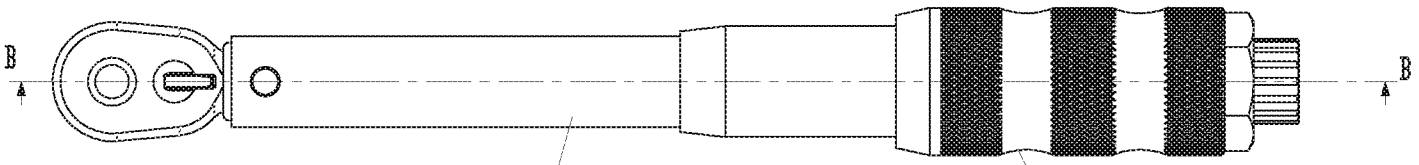
FIG. 8 is a top view of the torque structure in accordance with the preferred embodiment of the present invention.

5. Referring to FIG. 6 with reference to FIGS. 1-5, the third locking members 73 extend through the second through holes 61, and has a first end resting on and detachably received in one of the first receiving grooves 723, and a second end received or secured in one of the second receiving grooves 742. The second adjusting member 76 detachably rests on the fourth locking member 74. Thus, when the second adjusting member 76 is rotated relative to the fastening member 75, the fourth threaded portion 761 is rotated and moved relative to the third threaded portion 752, such that the second adjusting member 76 is moved to press or release the third locking members 73 and the fourth locking member 74. Therefore, the third locking members 73 is locked in or detached from the first receiving grooves 723, such that the first body 10 is locked onto or unlocked from the second body 20.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A torque structure comprising:

a first body, a second body, a first elastic member, a retaining unit, a first adjusting member, a positioning seat, and a locking unit;

wherein:

the first body has an interior provided with a receiving recess;

the second body is pivotally connected with the first body, and has a first end provided with a drive portion protruding from the first body, and a second end provided with a plurality of first fixing portions hidden in the receiving recess;

the first elastic member is received in and elastically biased on the second body;

the retaining unit is secured in the second body;

the retaining unit is distant from the drive portion, and includes a mounting seat, and a plurality of securing members;

the mounting seat is secured in the second body;

the mounting seat has an interior provided with a first threaded portion which is an internal thread extending through the mounting seat;

the mounting seat is provided with a plurality of second fixing portions aligning with the first fixing portions;

the mounting seat is provided with a plurality of first through holes;

the securing members are mounted on the first fixing portions and the second fixing portions, such that the mounting seat is secured in the second body;

the first adjusting member is mounted in the receiving recess, the second body, and the mounting seat, and has an external thread screwed through the first threaded portion;

the first adjusting member is rotated relative to the first threaded portion and moved relative to the retaining unit, such that the first adjusting member is moved relative to the second body;

the first adjusting member is provided with a head which presses the first elastic member, with the first elastic member being biased between the second body and the head;

the positioning seat is secured in the receiving recess and locked on the first adjusting member;

when the first body is rotated, the positioning seat and the first adjusting member are rotated, such that the first adjusting member is moved in the first threaded portion, and the positioning seat is moved with the first adjusting member, and is moved relative to the retaining unit;

the positioning seat is provided with a plurality of second through holes;

the positioning seat is provided with a second threaded portion which is an internal thread screwed onto the first adjusting member;

the locking unit is assembled with the first body, the retaining unit, the first adjusting member, and the positioning seat, and is moved with the first body;

the locking unit includes a plurality of first locking members, a second locking member, a plurality of third locking members, a fourth locking member, a fastening member, a second adjusting member, and a second elastic member;

the first locking members extend through and are moved in the first through holes;

the first locking members are received in the receiving recess;

each of the first locking members has a first end resting on the head;

the second locking member is received in the receiving recess and moved relative to the mounting seat;

the second locking member has a center provided with a third through hole allowing passage of the first adjusting member;

the second locking member has a first end provided with a plurality of resting portions each abutting and receiving a second end of each of the first locking members;

the second locking member has a second end provided with a plurality of first receiving grooves aligning with the second through holes;

the third locking members extend through the second through holes and are moved relative to the positioning seat;

each of the third locking members has a first end resting on and detachably received in one of the first receiving grooves;

the fourth locking member is received in the receiving recess and is provided with a plurality of second receiving grooves aligning with the second through holes;

each of the third locking members has a second end received or secured in one of the second receiving grooves, such that the third locking members are located between the second locking member and the fourth locking member;

the fourth locking member is provided with a first mounting portion;

the fastening member is secured to the first body such that the fastening member is rotated and moved with the first body;

the fastening member is provided with a fitting portion connected with the first body;

the fitting portion is an external thread screwed into an internal thread of the first body;

the fastening member is provided with a third threaded portion which is an internal thread;

the second adjusting member detachably rests on the fourth locking member, and is provided with a fourth threaded portion which is an external thread screwed into the third threaded portion;

when the second adjusting member is rotated relative to the fastening member, the fourth threaded portion is rotated and moved relative to the third threaded portion, such that the second adjusting member is moved to press or release the fourth locking member;

the fourth threaded portion is provided with a second mounting portion mounted on the first mounting portion, such that the second adjusting member is mounted on the fourth locking member; and the second elastic member is received in the receiving recess and is biased between the positioning seat and the second locking member.

2. The torque structure of claim 1, wherein:

the first body is a circular rod;

the receiving recess has a circular shape;

each of the first fixing portions is a circular hole;

each of the first through holes has a circular shape;

each of the securing members is a ball;

each of the second through holes is a circular hole;

the second locking member is a ring; and each of the resting portions is an arcuate groove.

3. The torque structure of claim 1, wherein each of the third locking members has a length smaller than that of each of the first locking members.

4. The torque structure of claim 1, wherein:

the first mounting portion is a circular hole;

the second receiving grooves is a circular groove; and the second mounting portion has a circular shape.

5. The torque structure of claim 1, wherein the drive portion is a hexagonal recess, and the first body is rotated about its axis to drive the second body.

6. The torque structure of claim 1, wherein:

the resting portions are formed on the head of the first adjusting member;

the first end of each of the first locking members rests on the resting portions of the first adjusting member;

the second end of each of the first locking members rests on the second locking member; and the second elastic member is biased between the positioning seat and the fourth locking member.

7. The torque structure of claim 1, wherein:

the mounting seat has two first through holes which are located between the second fixing portions;

each of the first through holes has an open shape;

the positioning seat has two second through holes;

each of the second through holes has an open shape and has a plane;

the first locking members and the second locking member are formed integrally;

the first locking members directly protrude from the second locking member;

the third locking members and the fourth locking member are formed integrally; and the third locking members directly protrude from the fourth locking member 74.

8. The torque structure of claim 1, wherein the third locking members and the second locking member are formed integrally, and the third locking members directly protrude from the second locking member.

* * * * *